United States Patent [19]

Properzi

[11] 4,150,816

[45] Apr. 24, 1979

[54] APPARATUS FOR COLLECTING AND COOLING HOT WIRE ROD

[76] Inventor: Giulio Properzi, Via Pietro Cossa, 1, Milan, Italy, 20100

[21] Appl. No.: 821,944

[22] Filed: Jul. 28, 1977

Related U.S. Application Data

[62] Division of Ser. No. 309,877, Nov. 27, 1972, abandoned.

[30] Foreign Application Priority Data

Dec. 2, 1971 [IT] Italy ..... 31970 A/71

[51] Int. Cl.[2] ..... C21D 9/56

[52] U.S. Cl. ..... 266/106

[58] Field of Search ..... 148/155, 156, 157; 140/2; 266/102, 106, 111, 112, 113

[56] References Cited

U.S. PATENT DOCUMENTS

| | | | |
|---|---|---|---|
| 854,810 | 5/1907 | Daniels | 140/2 X |
| 3,604,691 | 9/1971 | Sherwood | 266/112 X |
| 3,669,762 | 6/1972 | Takeo et al. | 266/112 X |
| 3,704,874 | 12/1972 | Van Den Bulcke | 266/106 X |
| 3,806,366 | 4/1974 | Cofer et al. | 266/113 X |

*Primary Examiner*—Gerald A. Dost
*Assistant Examiner*—Paul A. Bell
*Attorney, Agent, or Firm*—Guido Modiano; Albert Josif

[57] ABSTRACT

The present invention discloses an apparatus for collecting hot wire rod at the output of a rolling mill and cooling the same in such a manner that the same is prevented from being oxidized. The wire rod is conveyed to a coiler in a guide preventing the wire from coming into contact with air and then placed on a tape conveyor having a first portion immerged in a cooling fluid. The coiler is enclosed in a bell-shaped casing immerged in a cooling fluid so as to define and air-tight sealing. The spirals of wire carried by the conveyor are cooled before loaving the cooling fluid down to a temperature lower than the oxidation temperature thereof.

2 Claims, 3 Drawing Figures

APPARATUS FOR COLLECTING AND COOLING HOT WIRE ROD

BACKGROUND OF THE INVENTION

The present invention relates to an apparatus for collecting and for cooling hot wire rod at the output of a rolling mill.

The apparatus according to the invention is suitably located at the output of a finishing rolling mill which in turn is arranged downstream a continuous casting machine such as of the type comprising a rotating casting wheel.

Different systems for collecting hot wire rods at the output of a rolling mill are used at present, which are suitably designed to be used with a particular kind of processed material. In fact a distinction should be made between easily heat oxidable material and other materials in which the heat oxidation problem is not critical or in any case does not involve particular protection measures being taken. This second type of material comprises, among other, steel wires, while the first type of material mainly includes copper wires.

For processing continuous steel rods or bars a number of systems have been suggested for collecting and cooling such rods or bars at the output of the working rolling mill, which prevailingly comprises tubular guide sections through which the wire coming from the rolling mill is caused to pass and in which such wire can be cooled by means of water jets or the like, a coiler located downstream the guides and capable of arranging the wire in a coil arrangement, and possibly a continuous conveyor arranged to carry the coils continuously formed by the coiler to one or more subsequent processing and/or cooling stations and then to a collection station for the wire in the form of skeins or the like.

The coilers are substantially of a first and second types. Coilers of the first type also known as "Garret" coilers, substantially comprise a rotating basket into which the wire rod is caused to move in a tangential direction and forms coils due to movement of inertia. This type of coiler is not suitable for a continuous casting owing to its limitations as far as skein dimensions are concerned and above all because the same fail to collect wire rod coming from the rolling mill at a speed higher than 20 m/sec (rolling speeds higher than 40–50 m/sec can be reached at present).

The coiler of the second type also known as "Edenborn" coiler collects the wire rod by forming circular coils be means of a rotating terminal arranged above the collection zone. This system can be used with rolling mills having an output speed of the wire rod also higher than 20 m/sec.

The above systems do not include special measures for avoiding the oxidation of the wire rod and have been suggested for those materials, such as steel, in which the oxidation problems are not critical also because during the previous working or milling steps they are already oxidized. In fact, such coiler systems are generally more suitable for production of substantial amounts of rod but of limited quality and in order to refine the quality of the product additional processing equipment is required which not only increases the overall dimensions of the whole production plant, particularly as far as the length thereof is concerned, but also involves high costs. As a matter of fact for the different operations additional equipment and apparatuses are necessary which due to both the number and dimensions thereof lead to a plant having a volume in excess relative to its productivity.

For collecting hot wire rods of an easily oxidable material such as copper, the above systems which do not include any particular provision for protecting the material against oxidation at the output of the rolling mill, either are not suitable or they are too much complicated and cumbersome.

For these materials a collecting and cooling system has been suggested which on the one hand causes wire rod to undergo a milling operation outside the contact with the air possibly in an artificial reducing atmosphere, and on the other hand it requires the cooling of the wire rod before the same is discharged from the processing plant down to a temperature at which no substantial oxidation occurs, the cooling being always made preventing the contact with the air, possibly also in an artificial reducing atmosphere.

At the output of the rolling mill a long tubular guide is provided along which the hot wire rod is caused to pass and is cooled by means of water supplied to the tubular guide and then discharged through suitable openings or ducts, thereby preventing oxidation from occurring and decreasing the wire rod temperature below the oxidation temperature before the wire rod comes out of the tubular guide.

In practice, such system has a number of limitations and numerous inconveniences.

First of all, such system does not allow to carry out a processing fast enough and this owing to the provision of the tubular guide. If the speed has to be increased, a longer guide has to be provided in order to ensure the necessary cooling before the wire leaves the guide. A longer guide on the one hand substantially increases the length of the whole plant (it is not suitable to provide a curved guide with U-return in order to reduce the overall dimensions lengthwise) and on the other hand a serious problem arises for a proper forward movement of the wire rod. As a matter of fact due to the requirements of the rolling operation, the hot wire rod comes out in such temperature and stiffness conditions that the same can be easily bent upon meeting an obstacle and abruptly terminates the feeding or forward movement with the danger of damaging the plant in which the upstream rolling mill continuously supplies wire rod at a high speed.

Secondly such system does not allow wire rod with a small diameter such as a diameter of 3 mm, to be processed, for example as taught in U.S. Pat. No. 3,810,371 in the name of Mario Propero filed on Oct. 28, 1971. As disclosed in the above mentioned Patent it is possible to obtain directly from a rolling mill a wire rod with a diameter between 3 and6 mm with a glossy surface, i.e. with a perfectly pickled surface at the output of the rolling mill. If such a small diameter has to be obtained in a plant including a collecting and cooling system as described above, a major problem arises due to the bending effect mentioned above. Also in order to obtain a satisfactory output per hour, the wire must be produced at a high speed (higher than 40 m/sec), such speeds being unpracticable, as stated above, in a system with a tubular guide specified above.

The systems at present in use for producing wire rod cannot thus be employed or they can be used with unsatisfactory practical and economical results when a reasonably high output per hour and a wire rod of high quality are required and even more when a small diameter wire rod has to be produced in the conditions specified above.

SUMMARY OF THE INVENTION

An object of the present invention is that of providing an apparatus for collecting and cooling hot wire rod, which eliminates the inconveniences and limitations stated above of the known apparatuses and allows a high output of wire rod of high quality specifically by preventing the wire rod from being oxidized.

Another object of the present invention is that the said apparatus be suitable for any type of material with any diameter of the wire rod particularly for copper wire rod being of small diameter.

Another object of the invention is that of providing an apparatus of limited overall dimension lengthwise, particularly an apparatus which does not involve the use of long guide and cooling pipes for the wire rod.

Another object of the present invention is that of providing an apparatus which can be used with conventional rolling plants.

Another object of the invention is that of providing an apparatus with the possibility of carrying out the pickling operation in a rolling mill together with the collection of the wire rod or the like.

According to the invention there is provided an apparatus for collecting and cooling hot wire rod which comprises a coiler for the formation of coils arranged near the output of the rolling mill and a conveying means arranged to receive the coils formed by the said coiler and to convey the same to a collection unit in the form of skeins and the like, the said conveying means comprising at least a first portion thereof movably submerged in a cooling fluid and the said coiler being enclosed in a bell-shaped housing submerged in the said cooling fluid in order to provide an airtight connection between the said first portion of the conveying means and said coiler, airtight guiding means being provided for the said rolling mill between the coiler and the output of the rolling mill.

BRIEF DESCRIPTION OF THE DRAWINGS

Further details of the invention will appear from the detailed description of a preferred embodiment of an apparatus according to the invention, illustrated in the accompanying drawing in which.

DESCRITPION OF THE PREFERRED EMBODIMENT

In the following description reference will be made to a copper wire rod for which the oxidation effect is a major problem. It should be understood, however, that the invention is not limited to the processing of the copper wire rod but the same can also be advantageously employed with any suitable material.

With reference to the above figures, the apparatus according to the invention generally indicated at 1 is connected to the last unit 2 of a rolling mill through a casing 3 arranged in such a manner that the air cannot penetrate therein. More particularly this system is suitably provided for a rolling mill of the type disclosed in U.S. Pat. No. 3,810,371, in which the wire rod during the rolling operation undergoes a pickling processing and comes out of the mill in a perfectly pickled condition.

Figure 2:
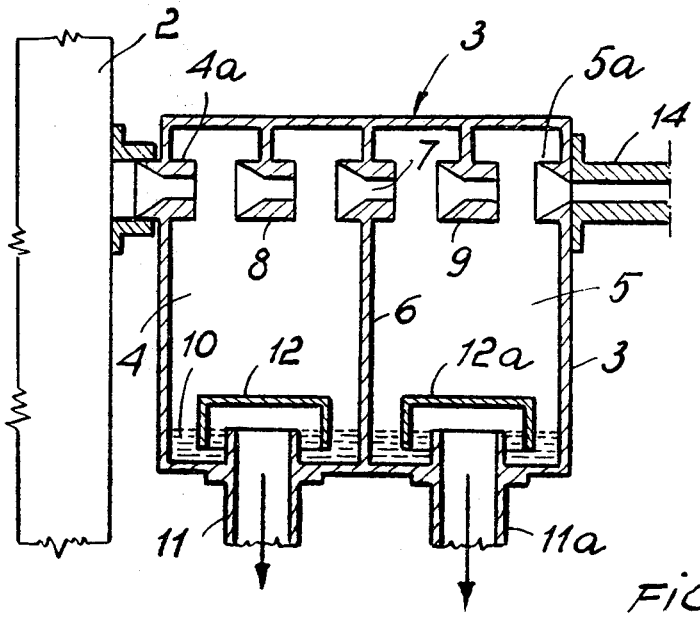
FIG. 2 is a vertical cross-section view on a larger scale of a detail of the connecting section between the guide means for the wire rod and the output of the rolling mill.
Figure 1B:
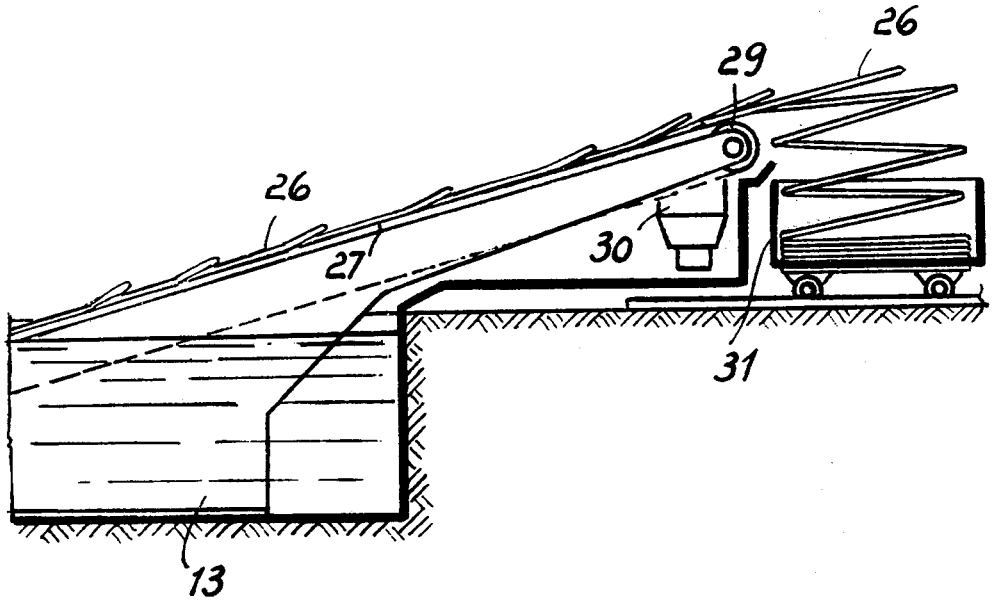

The casing 3 which is illustrated in cross-section view in FIG. 2 internally comprises a partition 6 which defines two airtight chambers 4 and 5. The partition 6 is formed with a hole or funnel 7 for the passage of the wire rod while further funnels 8 and 9 are arranged in the chambers 4 and 5 in order to additionally guide the said wire rod. The wire rod coming out of the last unit 2 of the rolling mill enters the casing 3 through a mouth 4*a* which is also in the shape of a funnel and comes out of the same casing through a funnel-shaped outlet 5*a*.

A liquid 10 which is used for the rolling and pickling operations falls into the first chamber 4 and is led to the outlet pipe 11 flowing underneath a bell-shaped lid 12 so as to prevent the air from flowing back to the said chamber 4 from the outlet pipe 11 arranged to convey the rolling or processing liquid 10 to the rolling mill.

A similar arrangement is provided in the second chamber 5 which is designed to convey the cooling water which is supplied to the apparatus according to the invention to an outlet pipe 11*a*, whose inlet is arranged below a bell-shaped lid 12*a*. The pipe 11*a* opens into a large tank 13 in which a cooling liquid medium such as water is maintained up to a determined level.

At the outlet 5*a* of the casing 3 a tubular guide 14 is tight connected along which the wire rod from the rolling mill is caused to pass. Along such tubular guide cooling water flows which is supplied from the tank 13 through a pump 15. More precisely the pump 15 delivers water through the filter 16 and the pipe 17 to the tubular guide 14 through branching off section 18 controlled by cocks 19.

The tubular guide 14 supplies the wire rod to a coiler mounted on a support 20. Such coiler comprises a bell-shaped housing 21 to which the end portion of the tubular guide 14 is secured so as the connection therebetween is airtight.

Inside the housing 21 a rotary member 25 of the coiler is mounted having a configuration similar to that of the known coiler of the "Edenborn" type. The rotary member 25 is journalled on bearing 22 and is actuated through a drive belt by a motor 23. The rotary member 25 is formed with a curve guide in the end portion thereof, so that the motion of rotation of the member 25 together with that of the wire rod results in the formation of coils or spirals 26.

The lower portion of the bell-shaped housing 21 is immerged into the water in the tank 13 and thus the coils 26 are formed in a space which is not in communication with the outer atmosphere and thus in a non-oxidizing environment.

The continuously formed spirals 26 fall into the water and go to rest on a conveyor 27 comprising an inclined conveyor tape which can slide on rollers 28 and 29 one of which is deeply immerged in the tank 13 and the other is arranged above the unloading level of the coils and is continuously actuated by a motor 30. The axis of the coiler 25 is preferably at right angles with the resting surface of the conveyor 27.

The said conveyor belt 27 first moves along a length under water where the coils of wire rod are caused to be cooled, then it conveys the coils to an unloading surface outside of the tank 13 into a collecting basket 31 where a skein is formed.

The operation of the apparatus according to the invention is as follows.

The wire rod coming from the rolling mill is guided inside the airtight tubular guide 14 where cooling water is supplied through the pump 15 via the pipe 17 and 18, thereby reaching the rotary member 25 of the coiler.

Figure 1A:
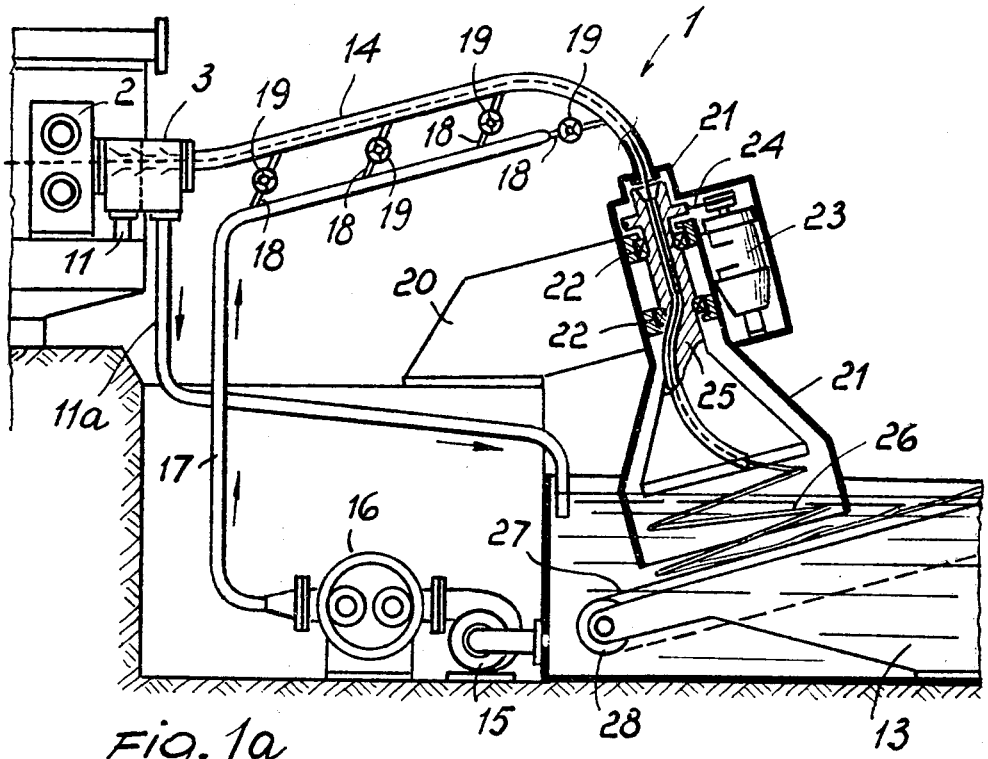
FIGS. 1*a* and 1*b* show diagrammatic side views of two adjacent portions of the apparatus, according to the invention, such adjacent portions being separated from one another for illustration purposes.

The cooling water flows through the said pipes in the directions indicated by arrows in FIG. 1*a* and is supplied to the tubular guide 14 from which the same partially flows to the outlet pipe 19*a* and partly to the rotary member 25. The partition 6 of the casing 3 separates the cooling water from the tank 13 from the liquid 10 employed for rolling purposes. As stated above, the air is prevented from entering both the casing 3 and the tubular guide 14.

The wire rod moves then into the tank 13 without coming into contact with the air and rests on a conveyor tape 27 below the bell housing 21 deeped in the water.

The coils 26 thus formed are moved by the conveyor belt 27 in the tank 13 and are cooled down to a temperature at which no oxidation occurs (the length of the path under water and the speed of the conveyor are determined so as to cause such cooling). The collecting operation is thus terminated at a zone outside the liquid medium of the tank 13 at a suitable temperature in a collecting basket 31.

The particular arrangement of the apparatus according to the invention also allows a pickling operation to be carried out while the wire rod is being collected, by adding the water in the tank 13 a suitable material such as sulphoric acid or the like in suitable percentages. It is also possible to add the water in the tank 13 waxy materials or the like in order to cause the wire rod skeins to be stored for a long time period without undergoing oxidation.

It should be noted that the wire rod is prevented from air contact starting from the output of the rolling mill up to a determined position where it comes out of the tank 13, where this wire rod has already reached a temperature at which no substantial oxidation can occur.

This result is obtained in a simple manner without employing additional apparatus for the collecting and cooling as well as refining operations because such operations are carried out at the same time in a single path which is of limited length owing to the coil arrangement of the wire rod. Thus high outputs per hour can be obtained without the necessity of providing long tubular guides for cooling purposes and thus the problems connected with these pipes are eliminated. It should be noted also that the first section of the guide 14 is limited in length and could be further reduced relative to the embodiment shown in FIG. 1*a* by moving the coiler closer to the output of the rolling mill. Indeed the cooling system for the guide 14 is only optional and could also be omitted in that proper cooling occurs in the tank 13. The length of the guide 14 does not depend any longer upon the complete cooling of the wire rod before coming out of the tank 13 as occurred in the prior art.

It should be understood that by inclining to a larger or less extent the conveyor belt 27 relative to a horizontal plane or by changing the speed thereof, the cooling time could be changed without however affecting the output for hour upstream thereof, i.e. the rolling speed which could remain the same.

Also it should be noted that the cooling operation is uniform in that any section of wire rod is progressively immerged into the tank 13 and undergoes the same processing as the previous or successive sections.

In order to facilitate the moving forward of the wire rod it is of course also possible to arrange rollers or the like inside the guide 14 or near the inlet of the coiler 25.

The overall dimensions of the apparatus is limited in length and also in any other direction particularly because no completely air-tight chambers are provided inside protection housings over the working zone, where the different operations are carried out. The whole apparatus from the output of the rolling mill to the output of the tape conveyor 27 does not need to be specially enveloped within an air-tight chamber where an artificial reducing atmosphere is provided, but only an air-tight enclosing for the coiler which is of limited dimensions is sufficient. In fact, by enclosing the whole apparatus within an air-tight chamber problems should be solved in order to provide a tight sealing owing to the fact that the wire rod should be allowed to come out of the chamber continuously for being collected in a skein configuration or the like, such problems being overcome according to the present invention by employing the tank 13 and the tight system thereby defined.

I claim:

1. An apparatus for collecting and cooling hot wire rod or the like at the output of a rolling mill, comprising a coiler for the formation of coils arranged near the output of the rolling mill, a conveying means arranged to receive the coils formed by the said coiler and to carry them to a collecting unit where the coils are collected to form skeins or the like, said conveying means having at least a first portion immerged and movable in a cooling liquid and a second portion extending outside said cooling liquid, a bell-shaped housing surrounding said coiler and immerged in said cooling liquid above said first portion of said conveying means to establish an air-tight closure between said first portion of said conveying means and said coiler, and air-tight guide means for said wire rod between the output of the rolling mill and said coiler.

2. An apparatus as claimed in claim 1, further comprising means for supplying said rolling mill with a treating liquid, and an air-tight box-like body for separating said treating liquid from said cooling liquid, said body being arranged between the output of the said rolling mill and said air-tight guide means for the wire rod, said box-like body internally comprising a partition defining two chambers for receiving said treating liquid and said cooling fluid, respectively, each of said chambers having at the lower portion thereof an outlet pipe projecting into said chambers and a bell-shaped lid having a border immerged into the liquid present in the lower portion of said chamber, thereby defining an air-tight connection between said outlet pipes and the inside of said chambers.

* * * * *